US008012037B2

(12) United States Patent
Evans et al.

(10) Patent No.: US 8,012,037 B2
(45) **Date of Patent: *Sep. 6, 2011**

(54) GOLF CLUB WITH REMOVABLE COMPONENTS

(75) Inventors: D. Clayton Evans, San Marcos, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/909,734

(22) Filed: Oct. 21, 2010

(65) Prior Publication Data

US 2011/0034266 A1 Feb. 10, 2011

Related U.S. Application Data

(63) Continuation of application No. 12/208,137, filed on Sep. 10, 2008, now Pat. No. 7,819,754.

(60) Provisional application No. 60/972,132, filed on Sep. 13, 2007.

(51) Int. Cl.
*A63B 53/02* (2006.01)

(52) U.S. Cl. ..... 473/307; 473/309; 473/345

(58) Field of Classification Search ..... 473/288, 473/307–309, 246, 345
See application file for complete search history.

(56) References Cited

U.S. PATENT DOCUMENTS

| | | | | |
|---|---|---|---|---|
| 1,167,387 | A | | 5/1916 | Daniel |
| 1,780,625 | A | | 4/1924 | Mattern |
| 1,638,616 | A | | 8/1927 | Burke |
| 1,895,417 | A | * | 1/1933 | Lard ..... 473/310 |
| 2,750,194 | A | | 1/1955 | Clark |
| 3,524,646 | A | * | 8/1970 | Wheeler ..... 473/288 |
| 3,692,306 | A | | 9/1972 | Glover |
| 3,897,066 | A | | 7/1975 | Belmont |
| 3,937,474 | A | | 2/1976 | Jepson et al. |
| 3,975,023 | A | | 8/1976 | Inamori |
| 3,989,248 | A | | 11/1976 | Campau |
| 4,021,047 | A | | 5/1977 | Mader |
| 4,136,982 | A | * | 1/1979 | Sagady ..... 403/108 |
| 4,568,088 | A | | 2/1986 | Kurahashi |
| 4,872,685 | A | | 10/1989 | Sun |
| 4,877,249 | A | | 10/1989 | Thompson |
| 5,106,094 | A | | 4/1992 | Desbiolles et al. |
| 5,176,681 | A | * | 1/1993 | Lawes et al. ..... 606/64 |
| 5,193,811 | A | | 3/1993 | Okumoto et al. |
| 5,282,624 | A | | 2/1994 | Viste |
| 5,310,185 | A | | 5/1994 | Viollaz et al. |
| 5,344,140 | A | | 9/1994 | Anderson |
| 5,346,216 | A | | 9/1994 | Aizawa |

(Continued)

*Primary Examiner* — Stephen L. Blau

(74) *Attorney, Agent, or Firm* — Michael A. Catania; Rebecca Hanovice; Sonia Lari

(57) ABSTRACT

A golf club having removable components includes a club head, a shaft, and a connection assembly. The club head includes a hosel having an upper treaded portion and a lower portion with a faceted cross-section. The connection assembly includes a sleeve mounted on the tip end of the shaft and a screw-cap. The sleeve, which has an aperture for receiving the tip end of the shaft, includes a lower section that has a multi-faceted surface for engaging the lower portion of the hosel. The screw-cap is mounted over the sleeve and includes a body having an upper area and a threaded area, the latter of which is capable of engaging the upper threaded portion of the hosel to removably secure the shaft to the club head.

18 Claims, 9 Drawing Sheets

U.S. PATENT DOCUMENTS 5,356,254 A * 10/1994 DiMaio et al. ..... 411/302
5,377,986 A 1/1995 Viollaz et al.
5,398,935 A 3/1995 Katayama
5,410,798 A 5/1995 Lo
5,425,538 A 6/1995 Vincent et al.
5,464,210 A 11/1995 Davis et al.
5,474,296 A 12/1995 Schmidt et al.
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,863,261 A 1/1999 Eggiman
5,888,148 A 3/1999 Allen
5,888,149 A * 3/1999 Allen ..... 473/309
5,906,549 A * 5/1999 Kubica ..... 473/314
5,947,840 A 9/1999 Ryan
6,042,278 A 3/2000 Spencer et al.
6,146,571 A 11/2000 Vincent et al.
6,152,833 A 11/2000 Werner et al.
6,165,081 A 12/2000 Chou
6,310,185 B1 10/2001 Wallace et al.
6,332,848 B1 12/2001 Long
6,348,015 B1 2/2002 Kosmatka
6,390,933 B1 5/2002 Galloway et al.
6,471,604 B2 10/2002 Hocknell et al.
6,491,592 B2 12/2002 Cackett et al.
6,565,452 B2 5/2003 Helmstetter et al.
6,582,323 B2 6/2003 Soracco et al.
6,602,149 B1 * 8/2003 Jacobson ..... 473/329
7,083,529 B2 * 8/2006 Cackett et al. ..... 473/309
7,144,332 B2 12/2006 Sugimae
7,258,623 B2 8/2007 Halleck
7,500,920 B2 3/2009 Sugimae
7,819,755 B2 10/2010 Sugimae
2003/0162599 A1 * 8/2003 Klein ..... 473/251
2004/0018887 A1 * 1/2004 Burrows ..... 473/307

* cited by examiner

GOLF CLUB WITH REMOVABLE COMPONENTS

CROSS REFERENCES TO RELATED APPLICATIONS

The present application is a continuation application of U.S. patent application Ser. No. 12/208,137, filed on Sep. 10, 2008, which claims priority to U.S. Provisional Application No. 60/972,132, filed on Sep. 13, 2007, now abandoned, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to a golf club having an improved connection for interchanging components.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

Two further examples are published applications to Burrows, U.S. Pub. Nos. 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. These connections typically add excessive weight to the club head, which affects the playability characteristics of the golf club. A change in the overall weight of a golf club alters the center of gravity and moments of inertias of the club head. Thus, a golf club with a shaft permanently affixed to a club head would have inherently different characteristics than a trial golf club that uses a prior art temporary connection to combine the same shaft and club head. In addition, many of these prior art connections are cumbersome to use. Some designs require the connection device to be accessed from the bottom of the club head, others from the top, with different tools and procedures for each.

BRIEF SUMMARY OF THE INVENTION

The present invention provides an improved club head-shaft connection that couples golf club heads and shafts in a manner that does not adversely affect the playability of the resulting golf club. The hosel of the club head is itself provided with a threaded portion and a rotation prevention portion. Therefore, fewer components are required for assembly, which reduces the overall weight of the connection and enables more discretionary weight to be distributed elsewhere in the club head.

In accordance with one embodiment of the invention, a golf club having removable components includes a club head, a shaft, and a connection assembly. The club head includes a body having a hosel. The hosel includes an upper treaded portion and a lower portion. The upper threaded portion of the hosel has a plurality of threads, which provide the upper threaded portion with a threaded cross-section. The lower portion of the hosel has a multi-faceted cross-section. The shaft has a tip end and a butt end. The connection assembly includes a sleeve mounted on the tip end of the shaft and a screw-cap. The sleeve has a body that includes a top section and a lower section. The lower section has a multi-faceted surface for engaging the lower portion of the hosel. The sleeve further includes an aperture for receiving the tip end of the shaft. The screw-cap has a body with a central aperture. The screw cap is mounted over the sleeve. The screw-cap body has an upper area and a threaded area, the latter of which capable of engaging the upper threaded portion of the hosel of the club head for removably securing the shaft to the club head.

In accordance with another embodiment of the invention, a golf club has a club head that includes a face cup and an aft-body. The face cup comprised of a metal material and including a striking face and a hosel. The hosel having an upper threaded portion and a lower portion. The upper threaded portion of the hosel has a plurality of threads thereon. The lower portion has a tapered, faceted cross-section. The golf club further includes a connection assembly comprising a sleeve and a screw-cap. The sleeve, which is mounted on the tip end of a shaft, includes a body having a top section and a lower section. The lower section of the sleeve has a tapered, multi-faceted surface for engaging the lower portion of the hosel. The sleeve further includes an aperture for receiving the tip end of the shaft. The screw-cap includes a body with a central aperture, the screw cap mounted over the sleeve, the body of the screw-cap having an upper area and a threaded area, the threaded area capable of engaging the upper threaded portion of the hosel of the club head for removably securing the shaft to the club head.

In a preferred embodiment, the lower section of the sleeve has three faceted surfaces. Once fully inserted into the hosel, the three sides of the sleeve will make contact with three mating surfaces designed in the lower portion of the hosel. Three sides are preferred to stop rotation both axially and around a pivot axis that is created when fewer than three contact points are achieved. When the screw-cap is tightened down on the sleeve, the screw-cap forces the multi-faceted lower section of the sleeve against the mating contact surfaces of the lower portion of the hosel of the golf club head, and all rotation is mechanically prohibited. This is superior to spline contact between the splines of a sleeve and those of a golf club head hosel, because there exists a small amount of axial slippage distance between the two splined surfaces. In addition, not having to machine the splines into the golf club head hosel provides cost savings.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
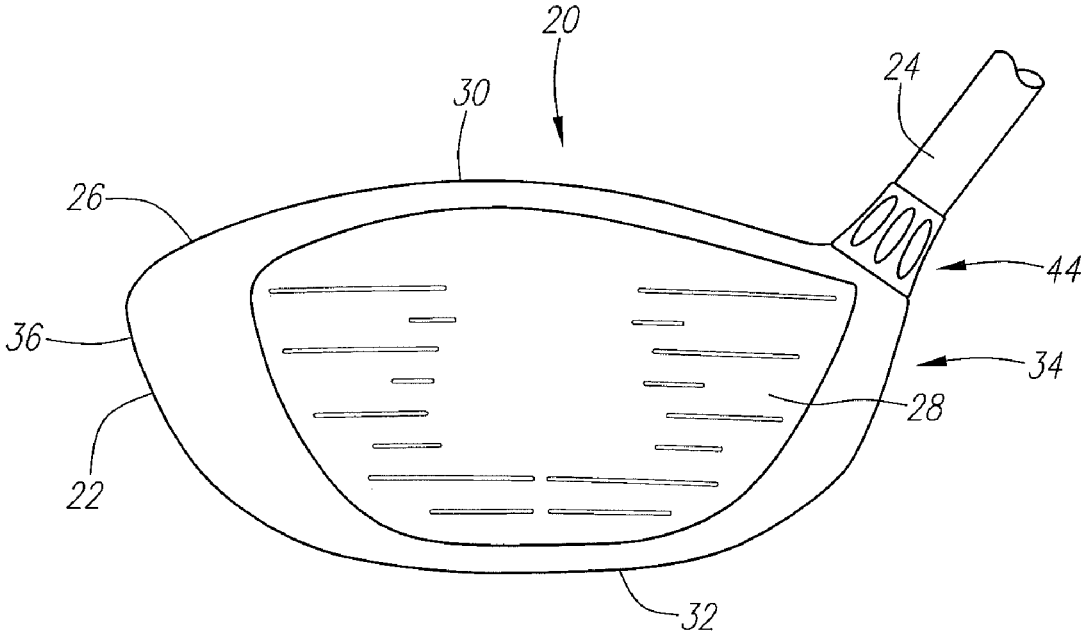
FIG. 1 is a front plan view of a golf club in accordance with the present invention.
Figure 2:
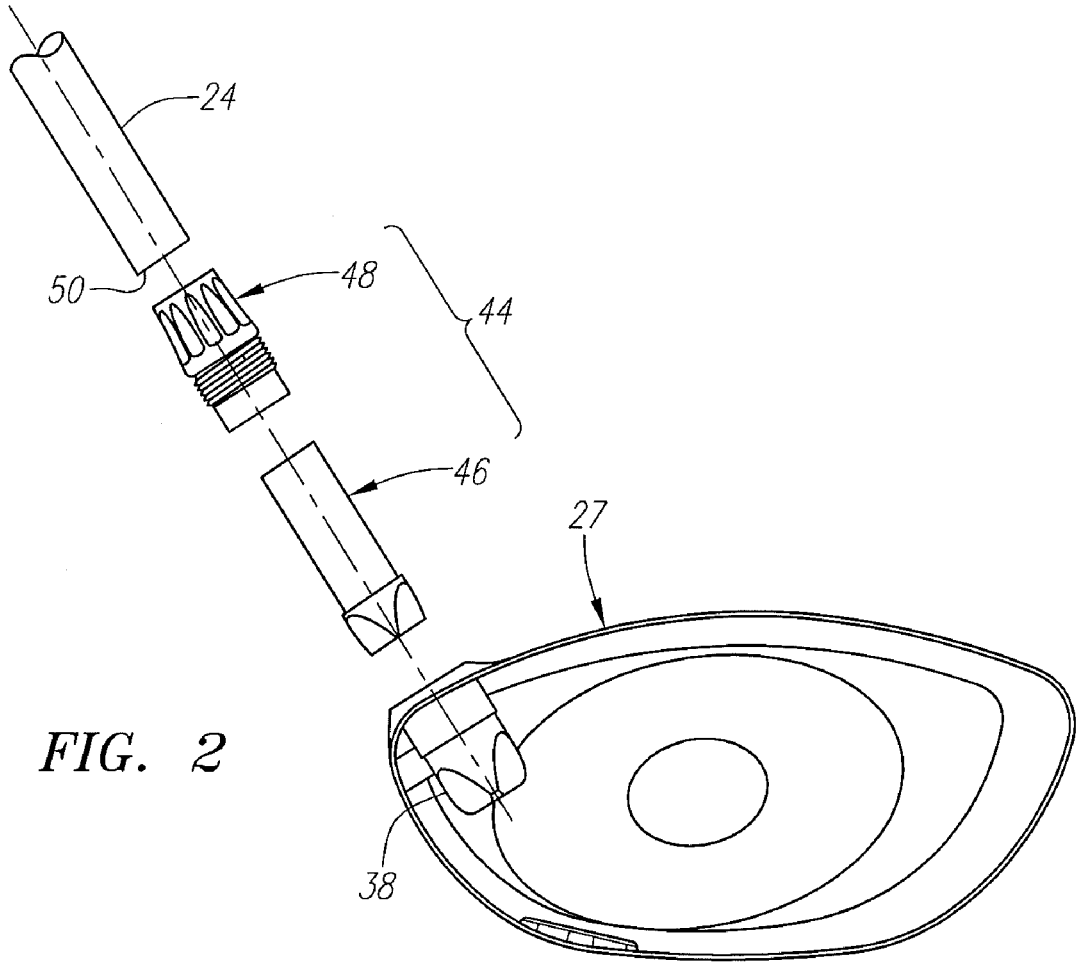
FIG. 2 is an exploded top perspective view of the golf club of FIG. 1 illustrating the various components, including a face cup portion of a club head, a shaft, and the connection assembly, which includes a sleeve and a screw-cap.
Figure 3:
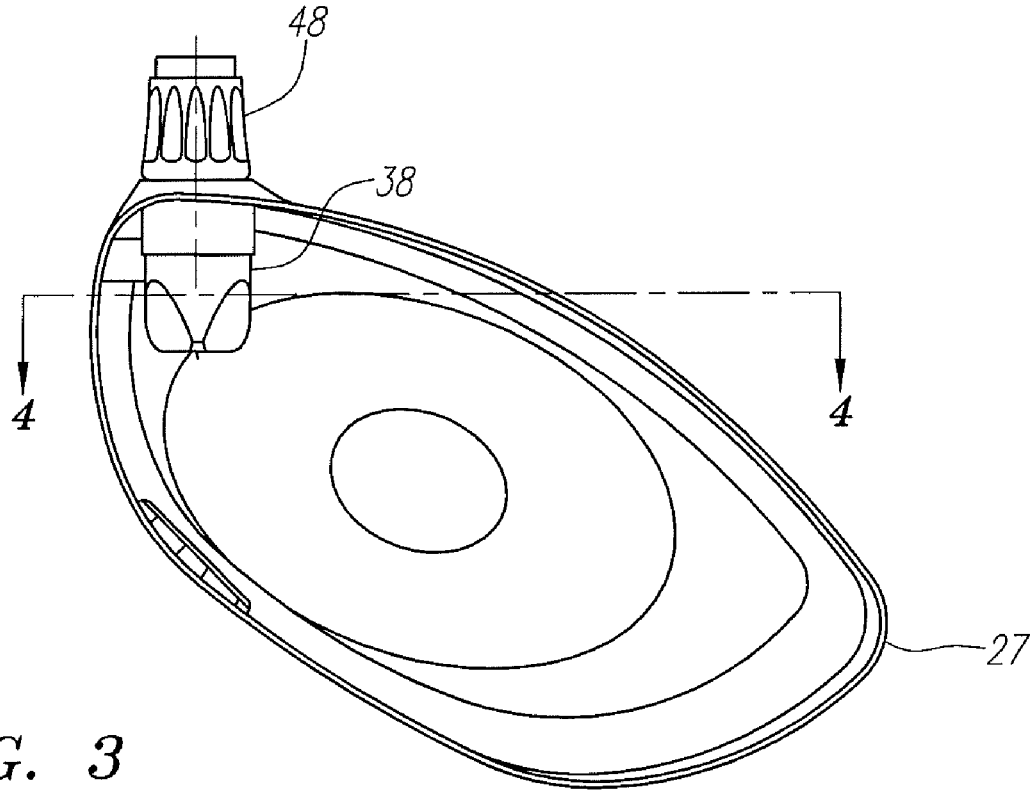
FIG. 3 is perspective view of the golf club of FIG. 2 in an assembled state.
Figure 4:
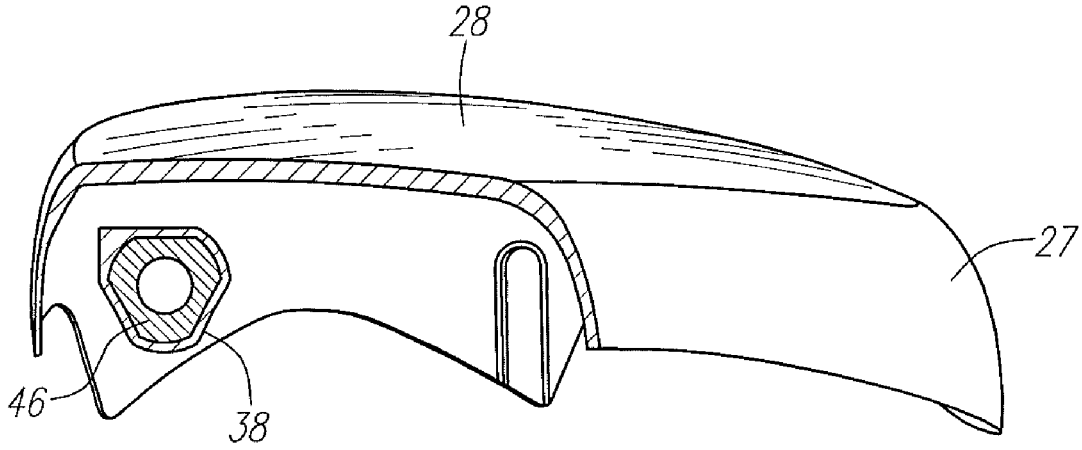
FIG. 4 is a cross-sectional view taken generally along the line 4-4 of FIG. 3.

As shown in FIGS. 1-5, a golf club is generally designated 20. Golf club 20 has a club head 22 and a shaft 24 that is coupled to club head 22. Club head 22 is preferably a wood-type golf club head, such as a driver, a fairway wood, or even a hybrid iron-wood-type club, but may also be an iron-type club head. Club head 22 includes a body 26 having a striking face 28, a crown portion 30, a sole portion 32, a heel end 34 and a toe end 36. Striking face 28 generally extends along the front of club head 22 from heel end 34 to toe end 36.

Body 26 is preferably composed of a metallic material, such as titanium, titanium alloy, stainless steel, or the like. Alternatively, body 26 may be composed of multiple materials, such as a metal face cup 27 attached to an aft-body composed of a different material, such as a carbon composite material, or a stainless steel body with a carbon composite crown. Body 26 preferably has a hollow interior and includes a hosel 38 for receiving shaft 24. Where body 26 is comprised of a cup face 27 and an aft-body, hosel 38 is provided in cup face 27. Hosel 38 is preferably an internal hosel that extends into body 26 with an opening 40 in crown portion 30. Alternatively, club head 22 may be provided with an external hosel (not shown) rather than an internal one.

Shaft 24 is preferably composed of a graphite material, however, it may be composed of a metallic material, such as stainless steel or titanium. Alternatively, shaft 24 may be composed of a hybrid of graphite and metal. Shaft 24 is coupled to club head 22 using a connection assembly 44 that provides for easy assembly, disassembly and reassembly, thereby facilitating customization of golf club 20.

The connection assembly 44 preferably comprises a sleeve 46 and a screw-cap 48. Connection assembly 44 cooperates with hosel 38 of club head 22 to secure shaft 24 to club head 22. Sleeve 46 is mounted on a tip end 50 of shaft 24. Shaft 24 with sleeve 46 mounted thereon is then inserted in hosel 38 of club head 22. Screw-cap 48 secures sleeve 46 to hosel 38 to retain shaft 24 in connection with club head 22.

As best illustrated in FIGS. 6A-6H, hosel 38 is preferably integrally formed with the body of club head 22. For example, club head 22 including hosel 38 may be cast of a suitable metal material, such as titanium alloys, steel alloys, magnesium and aluminum. Hosel 38 preferably has a main opening 58 for receiving a portion of sleeve 46 and shaft 24. Main opening 58 preferably has a depth $L_D$ of at least 1.000 inch, for example 1.065 inch. Hosel 38 includes an upper threaded portion 60 and a lower portion 62.

Upper threaded portion 60 includes a plurality of threads 64, which provide upper threaded portion 60 with a threaded cross-section. As best illustrated in FIGS. 6E-6H, upper threaded portion 60 preferably has a length $L_U$ in the range of 0.350 inch to 0.500 inch. The diameter $D_U$ at a top end of upper threaded portion 60 is preferably 0.580 inch. The plurality of threads 64 provided in upper threaded portion 60 preferably includes between one and ten threads, and more preferably between three and eight threads. In one embodiment of the invention, there are five threads 64 in upper threaded portion 60. Threads 64 preferably have a pitch in the range of six and thirty-two, more preferably between eighteen and twenty-eight, and even more preferably between twenty-four and twenty-eight. Threads 64 preferably have a pitch diameter PD in the range of 0.250 inch to 0.750 inch, more preferably in the range of 0.420 inch to 0.630 inch, and even more preferably between 0.530 inch and 0.570 inch.

Figure 6A:
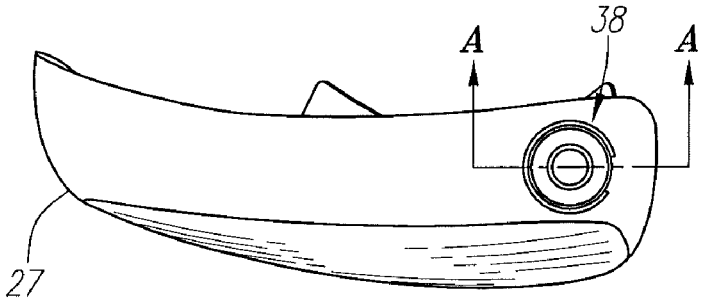
FIG. 6A is a top plan view of a face cup of a club head.
Figure 6B:
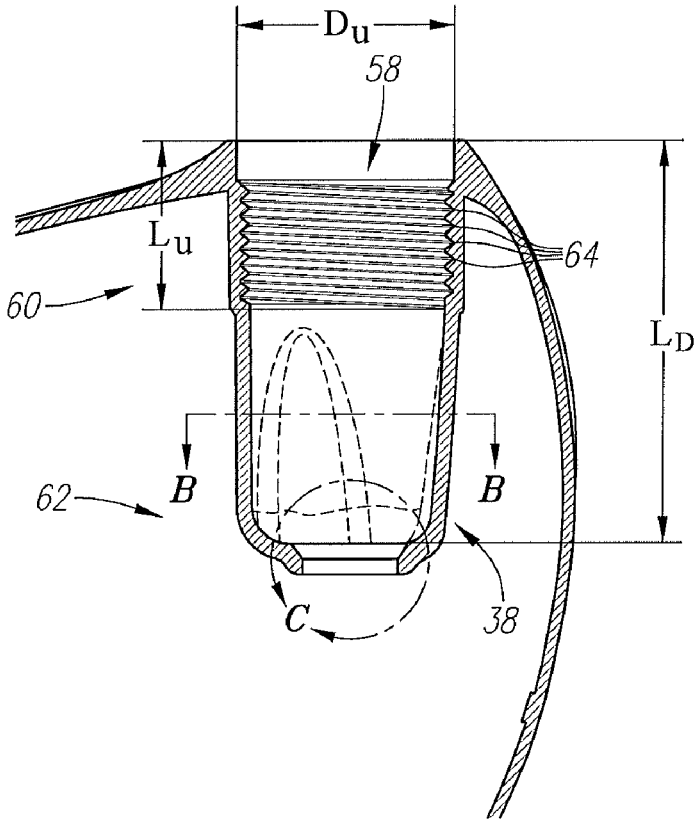
FIG. 6B is a cross-sectional view taken generally along the line A-A of FIG. 6A.
Figure 6C:
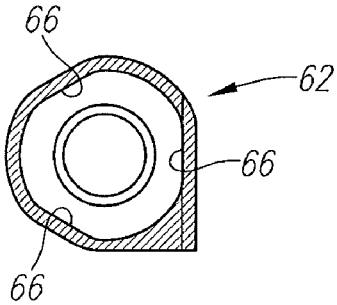
FIG. 6C is a cross-sectional view taken generally along the line B-B of FIG. 6B.
Figure 6D:
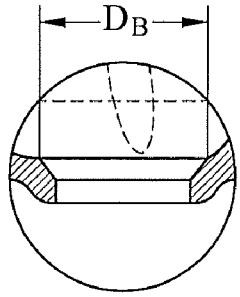
FIG. 6D is an enlarged sectional view taken along circle C of FIG. 6B.
Figure 6E:
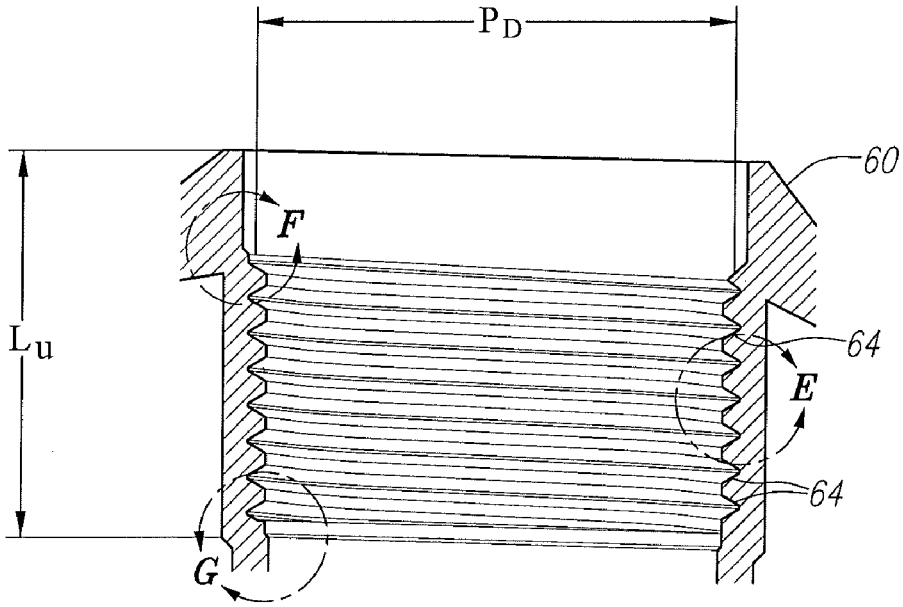
FIGS. 6E-6H are enlarged sectional views showing greater details of an upper threaded portion of the hosel.
Figure 6F:
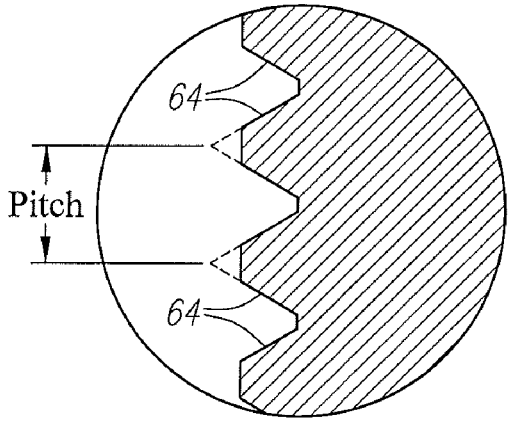
Figure 6G:
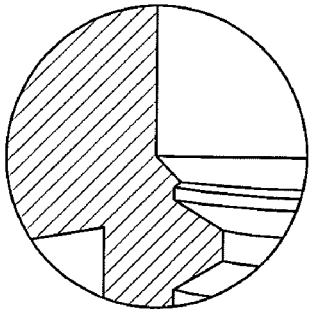
Figure 6H:
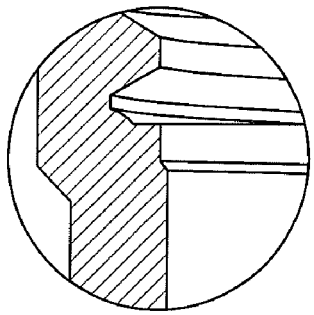
Figure 7A:
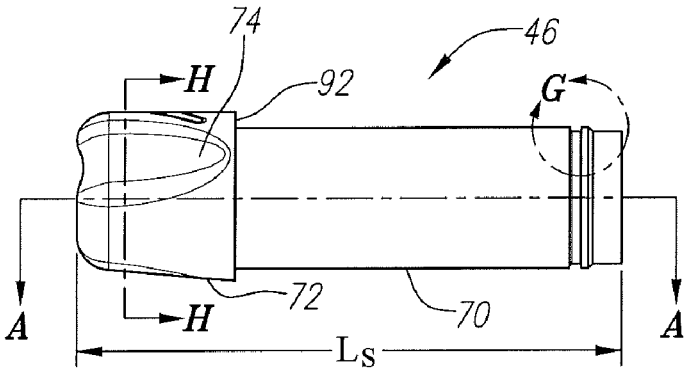
FIG. 7A is a plan view of a sleeve.
Figure 7B:
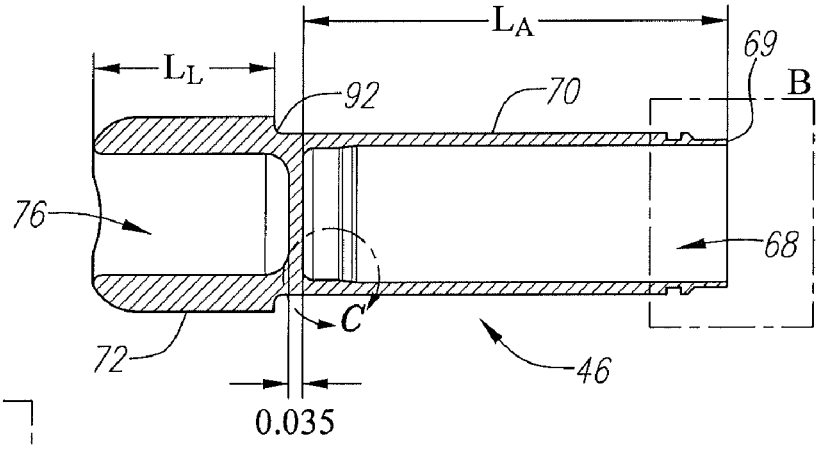
FIG. 7B is a cross-sectional view taken generally along the line A-A of FIG. 7A.
Figure 7C:
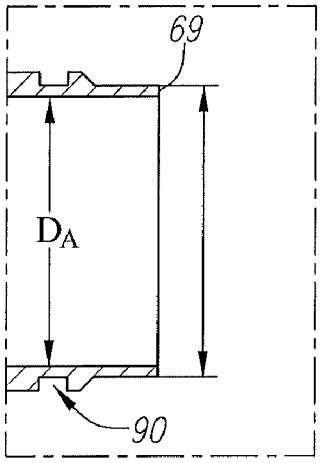
FIG. 7C is an enlarged sectional view taken generally along rectangle B of FIG. 7B.
Figure 7D:
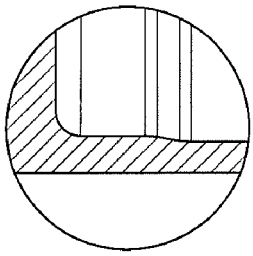
FIG. 7D is an enlarged sectional view taken generally along circle C of FIG. 7B.
Figure 7E:
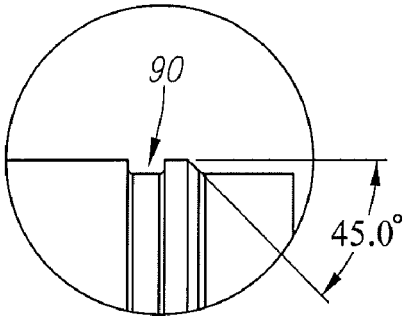
FIG. 7E is an enlarged view taken generally along circle G of FIG. 7A.
Figure 7F:
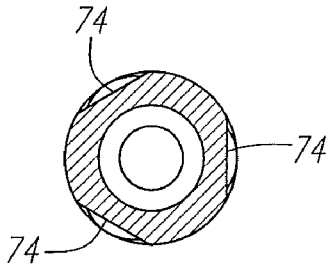
FIG. 7F is a cross-sectional view taken generally along the line H-H of FIG. 7A.
Figure 8A:
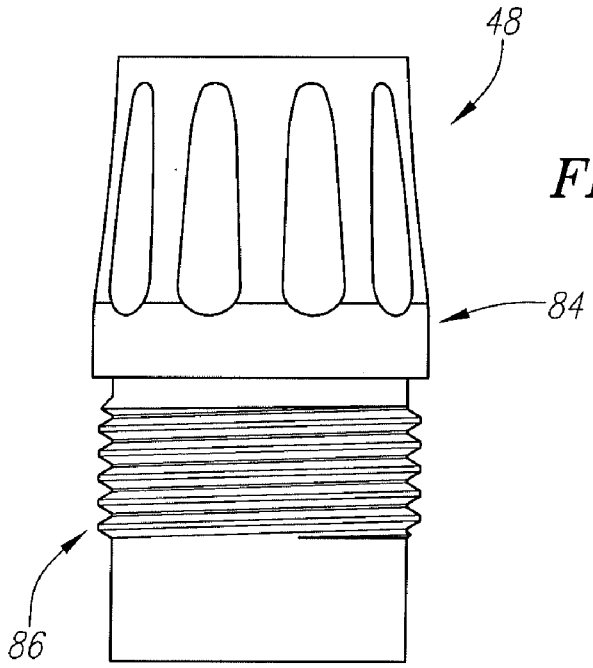
FIG. 8A is a plan view of a screw-cap.
Figure 8B:
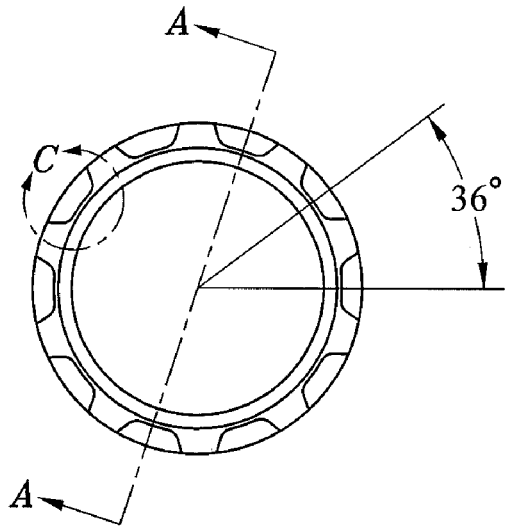
FIG. 8B is a top plan view of the screw-cap of FIG. 8A.
Figure 8C:
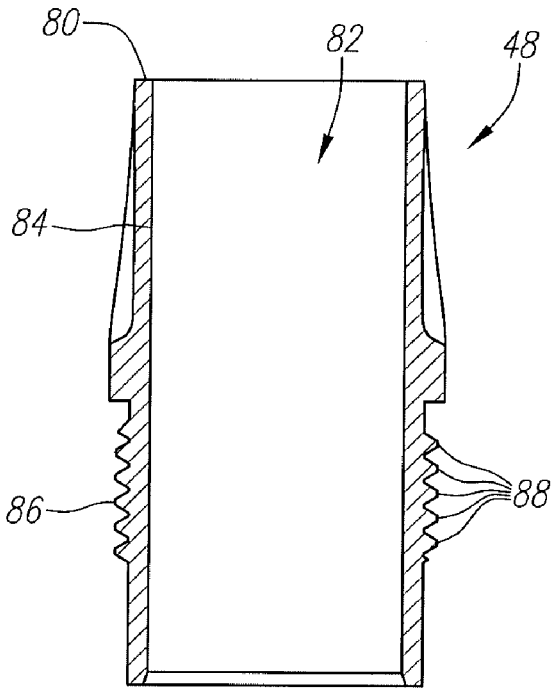
FIG. 8C is a cross-sectional view taken generally along the line A-A of FIG. 8B.

Lower portion 62 of hosel 38 has a faceted cross-section, which is best illustrated in FIG. 6C. In a preferred embodiment of the invention, lower portion 62 has at least three facets, planar surfaces 66, with a curved region provided between adjacent planar surfaces 66. In addition, lower portion 62 tapers from proximate upper threaded portion 60 to the bottom of hosel 36. By way of example, lower portion 62 may taper from a diameter of 0.517 inch proximate upper threaded portion 60 to a diameter $D_B$ of 0.312 inch proximate its bottom end. The taper of lower portion 62 ensures a snug fit between sleeve 46 and hosel 38, when shaft 24 is fully secured to club head 22.

Sleeve 46, which is best illustrated in FIGS. 7A-7F, has an aperture 68 formed in an upper end 69 thereof for receiving tip end 50 of shaft 24. Sleeve 46 is fixedly secured to shaft 24 using an adhesive, such as epoxy. Sleeve 46 is preferably comprised of a metal material, such as titanium alloys and aluminum alloys.

Sleeve 46, which preferably has an overall length $L_S$ of at least 1.500 inches, includes a body having a top section 70 and a lower section 72. Top section 70 has an aperture 68 formed therein. Aperture 68 has a diameter $D_A$ that complements the outer diameter of tip end 50 of shaft 24. Depth $L_A$ of aperture 68 is preferably sufficient to receive at least 1.000 inch of tip end of shaft. In one embodiment of the invention, depth $L_A$ is approximately 1.126 inches.

Lower section 72 of sleeve 46 has a multi-faceted exterior surface for engaging lower portion 62 of hosel 38. In one embodiment of the invention best illustrated in FIG. 7F, lower portion 62 has a pseudo-triangular cross-section with least three outer, planar surfaces 74, which will make contact with respective planar surfaces 66 of hosel 38. Regions between the planar surfaces 74 are curved. At least three sides are preferred to stop rotation, both axially and about a pivot axis that is created when there are fewer than three contact points. Lower section 72 of sleeve 46 is preferably slightly tapered to provide a snug fit in hosel 38. Lower section 72 has a length $L_L$ preferably in the range of 0.375 inch to 0.525 inch to provide sufficient contact surface area. When the screw-cap is tightened down on the sleeve, the screw-cap forces the multi-faceted lower section of the sleeve against the mating contact surfaces of the lower portion of the hosel of the golf club head, and all rotation is mechanically prohibited. Lower section 72 of sleeve 46 may be further provided with an opening 76 formed therein to remove excess weight from sleeve 46.

Screw-cap 48, illustrated in FIGS. 8A-8E, is preferably comprised of a lightweight metal material, such as a titanium alloy or an aluminum alloy. Screw-cap 48 includes a body 80 having a central aperture 82. Screw-cap 48 is mounted onto shaft 24 over sleeve 46. Screw cap 48 includes an upper area 84 and a threaded area 86. Threaded area 86 is provided with a plurality of threads 88, which engage threads 64 of upper threaded portion 60 of hosel 38 to secure shaft 24 to club head 22.

Figure 5:
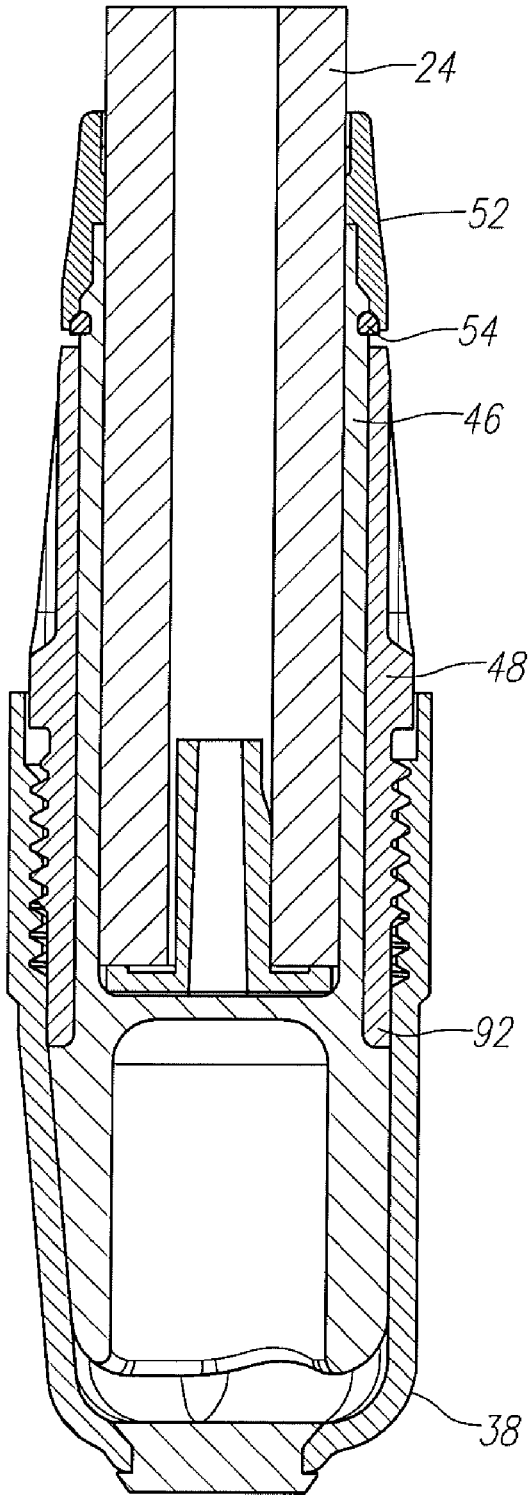
FIG. 5 is an enlarged cross-sectional view of a golf club shaft attached via the connection assembly to a hosel of a club head.
Figure 9A:
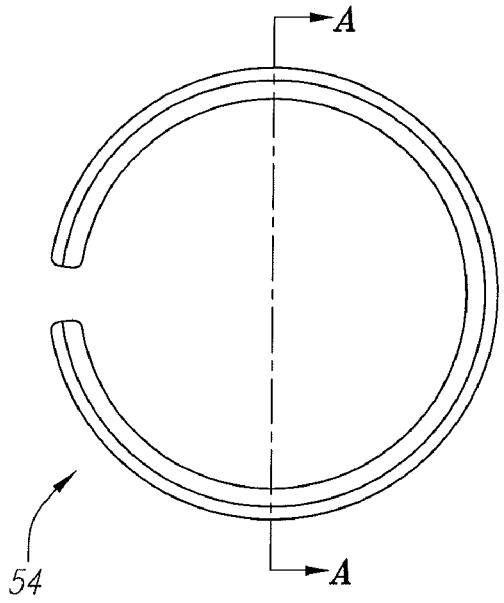
FIG. 9A is a plan view of a locking ring, which may be used in the connection assembly.
Figure 9B:
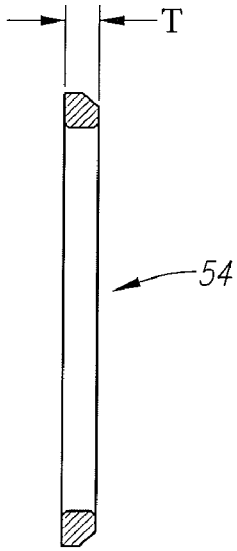
FIG. 9B is a cross-sectional view taken generally long the line A-A of FIG. 9A.

As illustrated in FIG. 5, connection assembly 44 may further include a locking ring 54 and a ferrule 52. Locking ring 54, shown in FIG. 9A and FIG. 9B, is preferably a thin metal ring having a thickness T in the range of 0.025 inch to 0.035 inch. Locking ring 54 is mounted in an annular groove 90 (FIGS. 7C and 7E) formed in top section 70 of sleeve 46. Locking ring 54 retains screw-cap 48 loosely on sleeve 46 and prevents screw-cap 48 from completely separating from hosel 38 of club head 22.

Figure 10A:
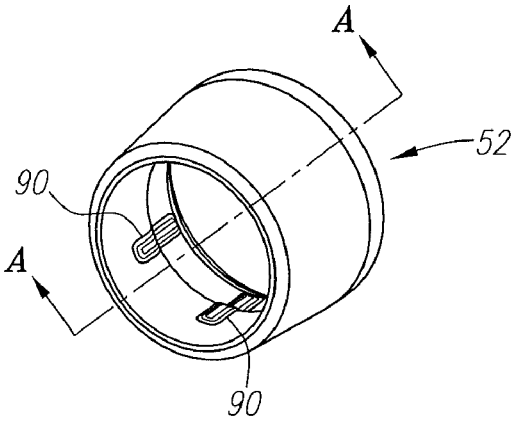
FIG. 10A is a perspective view of a ferrule, which may be used in the connection assembly.
Figure 10B:
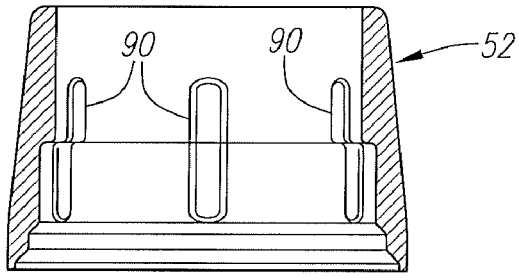
FIG. 10B is a cross sectional view taken generally along the line A-A of FIG. 10A.

Ferrule 52, shown separately in FIG. 10A and FIG. 10B, is preferably positioned on shaft 24 above the top section of sleeve 46. Ferrule 52, which may be composed of a lightweight, thermoplastic material, includes a body having a main aperture for receiving shaft 24. Ferrule 52 may further include a plurality of ribs 90 formed on its inside surface for aligning ferrule 52 on shaft 24

Golf club 20 is preferably assembled by placing ferrule 52, screw-cap 48, locking ring 54 and sleeve 46 over tip end 50 of shaft 24. Sleeve 46 is secured to shaft 24 by an adhesive, such as epoxy. Tip end 50 of shaft 24, with sleeve 46 affixed therein, is then inserted into hosel 38 of club head 22. The tapered multi-faceted surface of lower section 72 of sleeve 46 engages with lower portion 62 of hosel 38. Next, screw-cap 48 is slid along tip end 50 of shaft 24, such that its threads 88 engage threads 64 of upper threaded portion 60 of hosel 38. A special tool (not shown) may be provided to ensure that screw-cap 48 is properly tightened with the correct amount of torque. When screw-cap 48 is fully tightened to upper threaded portion 60 of hosel 38, the lower end of screw-cap 48 seats on a ledge 92 of sleeve 46 to prevent sleeve 46, and therefore shaft 24, from separating from club head 22. Locking ring 50 may then be placed in annular groove 90 of sleeve 46 to prevent screw-cap 48 from fully disengaging from hosel 38. Ferrule 52 is then secured onto shaft 24 and top section 70 of sleeve 46 just above screw-cap 48.

Figure 11A:
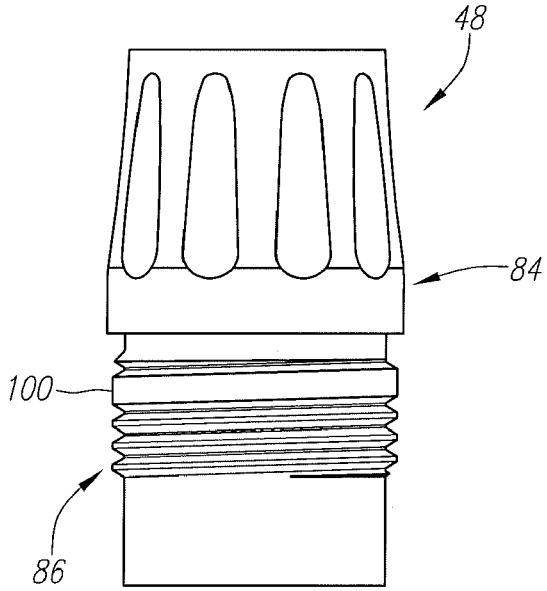
FIG. 11A is a plan view of a screw-cap with a polymeric patch.
Figure 11B:
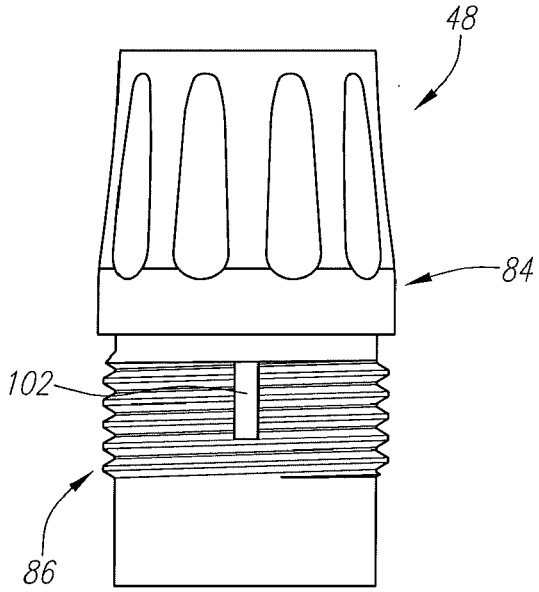
FIG. 11B is a plan view of a screw-cap with a polymeric strip.
Figure 11C:
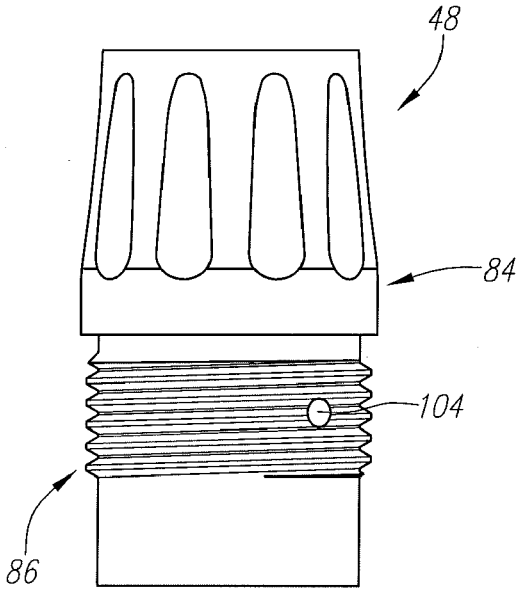
FIG. 11C is a plan view of a screw-cap with a polymeric pellet.

In addition to locking ring 50, a compressible polymeric material may be provided on some or all of the threads 88 of screw-cap 48. Alternatively, the polymeric material may be applied to threads 64 of hosel 38. When mating threads 64 and 88 of hosel 38 and screw-cap 48, respectively, are engaged, the polymeric material is compressed and a counterforce is created. This counterforce creates a stronger contact between the threads of the two components and creates a positive resistance to vibration and loosening. One such material is Nylok available from Nylok Corporation. FIGS. 11A-11C show various configurations of Nylok material on screw-cap 48. In FIG. 11A, a patch 100 of Nylok material may be coated over one or more threads 88 of screw-cap 48. Patch 100 may have a height in the range of 0.01 inch to 0.5 inch, more preferably in the range of 0.04 inch to 0.3 inch, and even more preferably in the range of 0.1 inch to 0.2 inch. Patch 100 preferably covers between one-half and ten threads 88, and more preferably between one and five threads 88. Patch 100 may extend completely about one or more threads 88 of screw-cap 48 or only a portion thereof. For example, patch 100 may extend anywhere between 30° and 360° about screw-cap 48. The thickness of patch 100 is preferably between 0.005 inch to 0.050 inch.

In FIG. 11B a strip 102 of Nylok material is coated across multiple threads 88 of screw-cap 48. Strip 102 may have a height in the range of 0.01 inch to 0.5 inch, more preferably in the range of 0.04 inch to 0.3 inch, and even more preferably in the range of 0.1 inch to 0.2 inch. The width of strip 102 may be between 0.01 inch and 0.2 inch, more preferably between 0.02 inch and 0.1 inch. Strip 102 preferably has a thickness of 0.03 to 0.15 inch.

FIG. 11C illustrates a pellet 104 of Nylok material embedded in threads 88 of screw-cap 48. Pellet 104 may have a diameter of between 0.01 inch and 0.6 inch, more preferably between 0.03 and 0.15 inch. The thickness of pellet 104 is preferably between 0.03 inch and 0.15 inch.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club having removable components, the golf club comprising:

a driver-type club head having a body with a metal hosel, the hosel having an upper threaded portion and a lower portion, the upper threaded portion having a threaded cross-section, the lower portion having a first mating contact surface;

a shaft comprising a graphite material having a tip end and a butt end; and a connection assembly comprising:

a metal sleeve mounted on the tip end of the shaft, the sleeve having a body including a top section and a lower section, the lower section having a second mating contact surface for engaging the first mating contact surface, the sleeve also comprising an aperture for receiving the tip end of the shaft;

a metal cap having a body with a central aperture, the cap mounted over the sleeve, the body of the cap having an upper area and a threaded area, the threaded area capable of engaging the upper threaded portion of the hosel of the club head for removably securing the shaft to the club head, a NYLOK polymeric coating provided on at least a portion of the threaded area of the cap; and a non-metallic ferrule having a body and a main aperture, wherein the shaft is placed through the main aperture, and the ferrule is positioned proximate the top section of the sleeve, wherein the ferrule comprises an inside surface having a plurality of ribs, wherein when the cap is tightened on the sleeve, the cap forces the second mating contact surface against the first mating contact surface and rotation of the shaft relative to the golf club head is mechanically prohibited.

2. The golf club according to claim 1, wherein the connection assembly further comprises a locking ring.

3. The golf club according to claim 2, wherein the top section of the sleeve comprises an annular groove, and wherein the locking ring is positioned in the annular groove to retain the cap loosely on the sleeve.

4. The golf club according to claim 2, wherein the locking ring is composed of a metal material and has a thickness in the range of 0.025 inch to 0.035 inch.

5. The golf club according to claim 1, wherein the sleeve is composed of a material selected from the group consisting of aluminum, aluminum alloy, stainless steel, titanium, and titanium alloy.

6. The golf club according to claim 1, wherein the cap is composed of a material selected from the group consisting of aluminum, aluminum alloy, stainless steel, titanium, and titanium alloy.

7. The golf club according to claim 1, wherein each of the lower section of the sleeve and the lower portion of the hosel is tapered.

8. The golf club according to claim 1, wherein the sleeve has an overall length of at least one inch.

9. The golf club according to claim 8, wherein the sleeve has an overall length of 1.5 inches.

10. The golf club according to claim 1, wherein the ferrule is composed of a lightweight thermoplastic material.

11. The golf club according to claim 1, wherein the club head is composed of a material selected from the group consisting of titanium, titanium alloy, and stainless steel.

12. The golf club according to claim 1, wherein the club head comprises both metallic and non-metallic materials.

13. The golf club according to claim 1, wherein the shaft further comprises a metal material.

14. A golf club having removable components, the golf club comprising:

a driver-type club head including a face cup and an aft-body, the face cup comprising a metal material and including a striking face and a hosel, the hosel having an upper threaded portion, a central portion and a lower portion, the upper threaded portion having a plurality of threads thereon, the central portion having a circular cross-section, and the lower portion having a first mating contact surface;

a shaft composed of a composite material having a tip end and a butt end; and a connection assembly comprising:

a metal sleeve mounted on the tip end of the shaft, the sleeve having a body with a top section and a lower section, the lower section having a second mating contact surface for engaging the lower portion of the hosel, the top section having an annular groove, the sleeve also comprising an aperture for receiving the tip end of the shaft;

a non-metallic ferrule having a body and a main aperture, wherein the shaft is placed through the main aperture, and the ferrule is positioned proximate the top section of the sleeve, wherein the ferrule comprises an inside surface having a plurality of ribs;

a cap having a body with a central aperture, the cap mounted over the sleeve, the body of the cap having an upper area and a threaded area, the threaded area capable of engaging the upper threaded portion of the hosel of the club head for removably securing the shaft to the club head;

a compressible polymeric material provided on least a portion of the threaded area of the cap or the threaded portion of the hosel; and a locking ring positioned in the annular groove to retain the cap loosely on the sleeve, wherein when the cap is tightened on the sleeve, the cap forces the second mating contact surface against the first mating contact surface and rotation of the shaft relative to the golf club head is mechanically prohibited.

15. The golf club according to claim 14, wherein the compressible polymeric material is NYLOK.

16. The golf club according to claim 14, wherein the sleeve has an overall length of at least one inch.

17. The golf club according to claim 14, wherein the sleeve is mounted on the shaft with an adhesive.

18. A golf club comprising:

a driver-type club head having a body with a metal hosel, the hosel having an upper threaded portion and a lower portion, the upper threaded portion having a threaded cross-section, the lower portion having a first mating contact surface;

a graphite shaft having a tip end and a butt end; and a connection assembly for removably attaching the club head to the shaft, the connection assembly comprising:

an aluminum sleeve mounted on the tip end of the shaft, the sleeve having a body including a top section and a lower section, the lower section having a second mating contact surface for engaging the first mating contact surface, the top section having an annular groove, the sleeve also comprising an aperture for receiving the tip end of the shaft;

a titanium cap having a body with a central aperture, the cap mounted over the sleeve, the body of the cap having an upper area and a threaded area, the threaded area capable of engaging the upper threaded portion of the hosel of the club head for removably securing the shaft to the club head, a NYLOK polymeric coating provided on at least a portion of the threaded area of the cap;

a metal locking ring positioned in the annular groove to retain the cap loosely on the sleeve; and a lightweight, thermoplastic ferrule having a body and a main aperture, wherein the shaft is placed through the main aperture, and the ferrule is positioned proximate the top section of the sleeve, wherein the ferrule comprises an inside surface having a plurality of ribs, wherein when the cap is tightened on the sleeve, the cap forces the second mating contact surface against the first mating contact surface and rotation of the shaft relative to the golf club head is mechanically prohibited.

* * * * *